US010774829B2

(12) United States Patent
Gubbins et al.

(10) Patent No.: US 10,774,829 B2
(45) Date of Patent: Sep. 15, 2020

(54) HYDRAULIC ARTIFICIAL LIFT FOR DRIVING DOWNHOLE PUMPS

(71) Applicant: Celtic Machining Ltd, Rainier (CA)

(72) Inventors: Martin E. C. Gubbins, Rainier (CA); Sven W. Larsen, Rainier (CA)

(73) Assignee: Celtic Machining Ltd., Rainier (CA)

( * ) Notice: Subject to any disclaimer, the term of this patent is extended or adjusted under 35 U.S.C. 154(b) by 72 days.

(21) Appl. No.: 15/800,717

(22) Filed: Nov. 1, 2017

(65) Prior Publication Data

US 2018/0135620 A1 May 17, 2018

Related U.S. Application Data

(60) Provisional application No. 62/417,107, filed on Nov. 3, 2016.

(51) Int. Cl.

| | |
|---|---|
| ***E21B 6/04*** | (2006.01) |
| ***F04B 53/14*** | (2006.01) |
| ***F04B 47/08*** | (2006.01) |
| ***F04B 47/04*** | (2006.01) |
| ***E21B 43/12*** | (2006.01) |

(Continued)

(52) U.S. Cl.

CPC ..... *F04B 53/147* (2013.01); *E21B 19/163* (2013.01); *E21B 43/126* (2013.01); *E21B 43/129* (2013.01); *E21B 47/117* (2020.05); *F04B 19/003* (2013.01); *F04B 47/02* (2013.01); *F04B 47/04* (2013.01); *F04B 47/08* (2013.01); *F04B 53/14* (2013.01); *E21B 4/003* (2013.01); *E21B 6/04* (2013.01); *F04B 17/03* (2013.01); *F04B 53/12* (2013.01); *F04B 2201/0201* (2013.01); *F15B 15/1414* (2013.01); *F15B 15/2823* (2013.01); *F15B 15/2861* (2013.01)

(58) Field of Classification Search

CPC ..... F15B 15/2823; F15B 15/2861; F15B 15/1414; E21B 6/04; F04B 47/04; F04B 2201/0208

See application file for complete search history.

(56) References Cited

U.S. PATENT DOCUMENTS 1,793,793 A * 2/1931 Granger ..... F04B 47/04 417/260
1,850,484 A * 3/1932 Watkins ..... F04B 47/04 417/137

(Continued)

*Primary Examiner* — F Daniel Lopez
(74) *Attorney, Agent, or Firm* — Kyle R Satterwaite; Ryan W Dupuis; Ade & Company Inc.

(57) ABSTRACT

A hydraulic lift apparatus for operating a downhole pump features a hydraulic linear actuator with a piston longitudinally slidable on a central axis of a rotatable portion of a housing. An anti-rotation rod runs longitudinally through the piston at a position radially offset outwardly from the central axis to prevent rotation between the piston and housing. A stationary motor powers a drive train whose output is connected to the rotatable portion of the housing and centered on the central axis. The actuator is one-way actuator with a hydraulically driven upstroke. A leak detection passage extends through the piston to collect fluid that has leaked across the piston seals and convey it to a leak detection port and associated containment tank. A position sensor for monitoring the piston movement features a sensing rod depending downwardly into a hollow piston shaft carried by the piston and connected to the pump rod.

15 Claims, 11 Drawing Sheets

(51) Int. Cl.

| | |
|---|---|
| ***E21B 47/117*** | (2012.01) |
| ***E21B 19/16*** | (2006.01) |
| ***F04B 19/00*** | (2006.01) |
| ***F04B 47/02*** | (2006.01) |
| *F15B 15/28* | (2006.01) |
| *F15B 15/14* | (2006.01) |
| *E21B 4/00* | (2006.01) |
| *F04B 17/03* | (2006.01) |
| *F04B 53/12* | (2006.01) |

(56) References Cited

U.S. PATENT DOCUMENTS

| | | | | |
|---|---|---|---|---|
| 2,408,075 | A * | 9/1946 | Kowalski, Jr. | F04B 47/04 417/401 |
| 3,135,164 | A * | 6/1964 | Scotto | F15B 15/24 91/47 |
| 3,403,365 | A * | 9/1968 | Richards | F15B 15/2823 336/30 |
| 4,631,918 | A * | 12/1986 | Rosman | F04B 47/04 60/372 |
| 5,150,049 | A * | 9/1992 | Schuetz | F15B 15/2892 324/207.12 |
| 6,854,515 | B2 * | 2/2005 | Matthews | E21B 33/03 166/68.5 |
| 7,562,701 | B2 * | 7/2009 | Lacusta | E21B 33/03 166/68.5 |
| 2019/0170167 | A1 * | 6/2019 | Odaka | F15B 15/28 |

* cited by examiner

HYDRAULIC ARTIFICIAL LIFT FOR DRIVING DOWNHOLE PUMPS

CROSS-REFERENCE TO RELATED APPLICATIONS

This application claims benefit under 35 U.S.C. 119(e) of U.S. Provisional Application No. 62/417,107, filed Nov. 3, 2016.

FIELD OF THE INVENTION

The present invention relates generally to artificial lift systems for reciprocating a pump rod in a wellbore to drive a downhole pump in order to produce well fluids up to the surface, and more specifically to hydraulic artificial lift systems using a hydraulic linear actuator to drive such reciprocal motion of the pump rod.

BACKGROUND

Hydraulic lift systems of the forgoing type for driving downhole pumps in well applications are known in the art, and include those disclosed in US2012/0148418, US2014/0234122, US2014/0079560, US2015/0176573, US2015/0285243, U.S. Pat. Nos. 7,562,701, 8,083,499, and 8,562,308.

Among these references, U.S. Pat. No. 8,083,499 discloses offsetting of the piston rod from the central longitudinal axis of the cylinder in order to resist rotation of the piston relative to the cylinder, thereby preventing damage to a position sensor probe along which the piston is slidable. In this reference, the piston rod extends vertically upward from the hydraulic linear actuator and is indirectly coupled to the pump rod via a cable routed over a sheave that is carried atop the piston rod.

U.S. Pat. No. 7,562,701 also discloses prevention of piston rotation relative to the cylinder in a hydraulic lift apparatus by offsetting of components relative to the central longitudinal axis of the cylinder, but does so for the purpose of enabling rotational manipulation of downhole equipment. The hydraulic linear actuator is installed within an uppermost portion of the wellhead casing rather than atop the wellhead, and so hydraulic supply lines enter the upper end of the cylinder and are routed downwardly through the piston in order to pressurize the cylinder below the piston to drive the upstroke, and a hollow ram accommodates passage of the well fluid to the surface. The ram and fluid supply lines are offset from the central longitudinal axis of the cylinder to prevent rotation of the piston.

US20140234122, US20120148418 and US20150176573 disclose hydraulic lift systems that, like U.S. Pat. No. 8,083,499, employ a magnetorestrictive probe to monitor the position of the sliding piston, but place this probe externally of the cylinder and have the piston rod extending downwardly from the cylinder for inline connection to the pump rod.

Disclosures concerning piston rotation prevention and piston position detection in the general area of piston cylinder assemblies used in other applications be found in JP2005054977 and U.S. Pat. No. 7,493,995.

Applicant has developed a new hydraulic lift design incorporating unique features neither shown or suggested by the prior art

SUMMARY OF THE INVENTION

According to a first aspect of the invention, there is provided a hydraulic artificial lift apparatus for operating a downhole pump of a well to produce fluids therefrom, the artificial lift apparatus comprising:

a housing having a top end and an opposing bottom end spaced apart in a longitudinal direction of the housing;

a piston slidably disposed within a hollow interior space of the housing for movement back and forth the longitudinal direction between an uppermost travel limit and an opposing lowermost travel limit, said piston being centered on a central longitudinal axis of the housing and sealed to a circumferential wall of the housing by at least one piston seal;

a piston shaft attached to the piston and extending downward therefrom and exiting the housing through the bottom end thereof, which features a sealed closure of the housing around said piston shaft, a lower end of the piston shaft being disposed outside the housing below the bottom end thereof and connected or connectable to the upper end of a pump rod for reciprocal driving of the downhole pump by said movement of the piston;

an upstroke supply port connected or connectable to a source of pressurized hydraulic fluid and entering the housing, and communicating with the interior space thereof, at a lower portion of the housing disposed between the sealed closure and a lowermost position occupied by the at least one piston seal at the lowermost travel limit of the piston, whereby the hydraulic fluid drives an upstroke of the piston; and at least one anti-rotation rod running longitudinally of the hollow interior space of the housing and through the piston at a position radially offset outwardly from the central longitudinal axis, the piston being longitudinally slidable on said at least anti-rotation rod between the uppermost and lowermost travel limits.

According to a second aspect of the invention, there is provided a hydraulic artificial lift apparatus for operating a downhole pump of a well to produce fluids therefrom, the artificial lift apparatus comprising:

a housing having a top end and an opposing bottom end spaced apart in a longitudinal direction of the housing;

a piston slidably disposed within a hollow interior space of the housing for movement back and forth the longitudinal direction;

a piston shaft attached to the piston and extending downward therefrom and exiting the hollow interior space of the housing through the bottom end thereof, which features a sealed closure of the housing around said piston shaft, a lower end of the piston shaft being disposed outside the housing below the bottom end thereof and connected or connectable to the upper end of a pump rod string for reciprocal driving of the downhole pump by said movement of the piston;

a upstroke supply port connected or connectable to a source of pressurized hydraulic and communicating with the hollow interior space of the housing at a lower portion thereof to drive an upstroke of the piston under introduction of the pressurized hydraulic fluid through said upstroke supply port;

a hollow interior bore extending axially into a top end the piston shaft and communicating with the hollow interior space of the housing above the piston, and a rod running longitudinally of the hollow interior space of the housing from a supported position above an upper travel limit of the piston, and extending downwardly through the piston into the hollow interior bore of the piston shaft;

wherein the piston is movable back and forth along said rod in the longitudinal direction.

According to a third aspect of the invention, there is provided a hydraulic artificial lift apparatus for operating a downhole pump of a well to produce fluids therefrom, the artificial lift apparatus comprising:

a housing having a top end and an opposing bottom end spaced apart in a longitudinal direction of the housing;

a piston slidably disposed within a hollow interior space of the housing for movement back and forth the longitudinal direction between an uppermost travel limit and an opposing lowermost travel limit, said piston being sealed to a circumferential wall of the housing by at least one piston seal;

a piston shaft attached to the piston and extending downward therefrom and exiting the hollow interior space of the housing through the bottom end thereof, which features a sealed closure of the housing around said piston shaft, a lower end of the piston shaft being disposed outside the housing below the bottom end thereof and connected or connectable to the upper end of a pump rod for reciprocal driving of the downhole pump by said movement of the piston;

an upstroke supply port connected or connectable to a source of pressurized hydraulic fluid and entering the housing, and communicating with the interior space thereof, at a lower portion of the housing disposed between the sealed closure and a lowermost position occupied by the at least one piston seal at the lowermost travel limit of the piston, whereby the hydraulic fluid drives an upstroke of the piston, the housing lacking a downstroke port at an upper portion of the housing above an uppermost position occupied by the at least one piston seal at the uppermost travel limit of the piston; and a leak detection fluid passage passing through the piston, communicating with the hollow interior space of the housing at the upper portion thereof, and communicating with a leak detection port at the lower portion of the housing, whereby, in the event of leakage of the pressurized hydraulic fluid upwardly past the piston, leaked fluid above the piston is forced into the leak detection fluid passage as the piston reaches the upper travel limit during the upstroke, and detection of hydraulic fluid in or from the leak detection port confirms occurrence of said leakage.

According to a fourth aspect of the invention, there is provided a hydraulic artificial lift apparatus for operating a downhole pump of a well to produce fluids therefrom, the artificial lift apparatus comprising:

a housing enclosing a hollow interior space and having opposing top and bottom ends spaced apart along a longitudinal axis of the housing, the housing comprising a rotatable portion supported for rotation about said longitudinal axis;

a piston slidably disposed within the rotatable portion of the housing for movement back and forth along the longitudinal axis of the housing within the hollow interior space thereof, the piston being locked against rotation relative to the rotatable portion of the housing;

a piston shaft attached to the piston and extending downward therefrom and exiting the hollow interior space of the housing through the bottom end thereof, which features a sealed closure of the housing around said piston shaft, a lower end of the piston shaft being disposed outside the housing below the bottom end thereof and connected or connectable to the upper end of a pump rod string for reciprocal driving of the downhole pump by said movement of the piston;

a upstroke supply port connected or connectable to a source of pressurized hydraulic and communicating with the hollow interior space of the housing at a lower portion thereof to drive an upstroke of the piston under introduction of the pressurized hydraulic fluid through said upstroke supply port; and a rotational actuation device operable to effect controlled rotation of the rotatable portion of the housing about the longitudinal axis thereof, said rotational actuation device comprising a motor mounted in a stationary position relative to the well and a drive train comprising an input member rotationally driven by the motor and an output member connected to the rotatable portion of the housing in a position centered on the longitudinal axis.

BRIEF DESCRIPTION OF THE DRAWINGS

Preferred embodiments of the invention will now be described in conjunction with the accompanying drawings in which.

DETAILED DESCRIPTION

Figure 1:
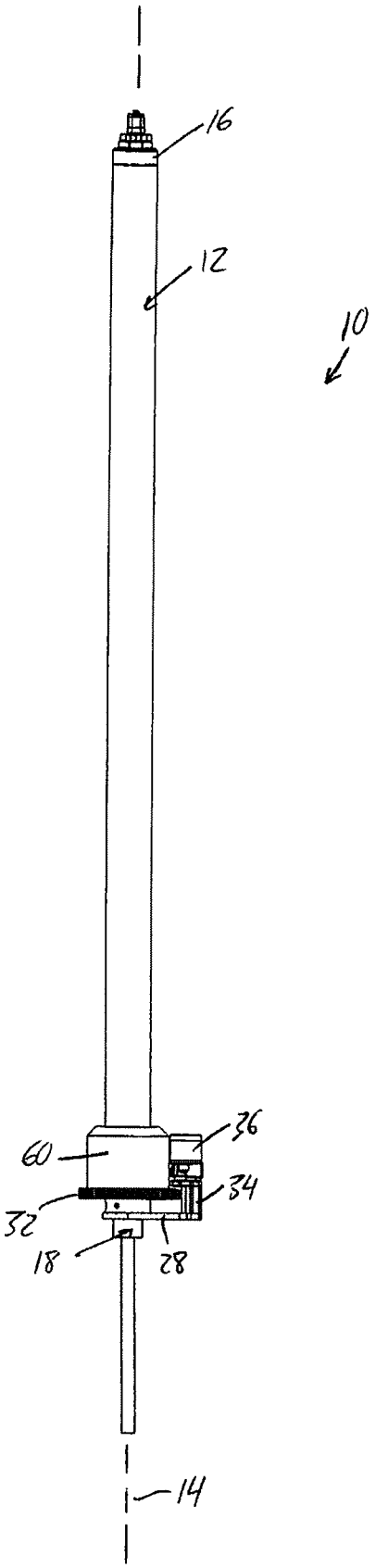
FIG. 1 is a front elevational view of an artificial lift unit according to a first embodiment of the present invention.
Figure 2:
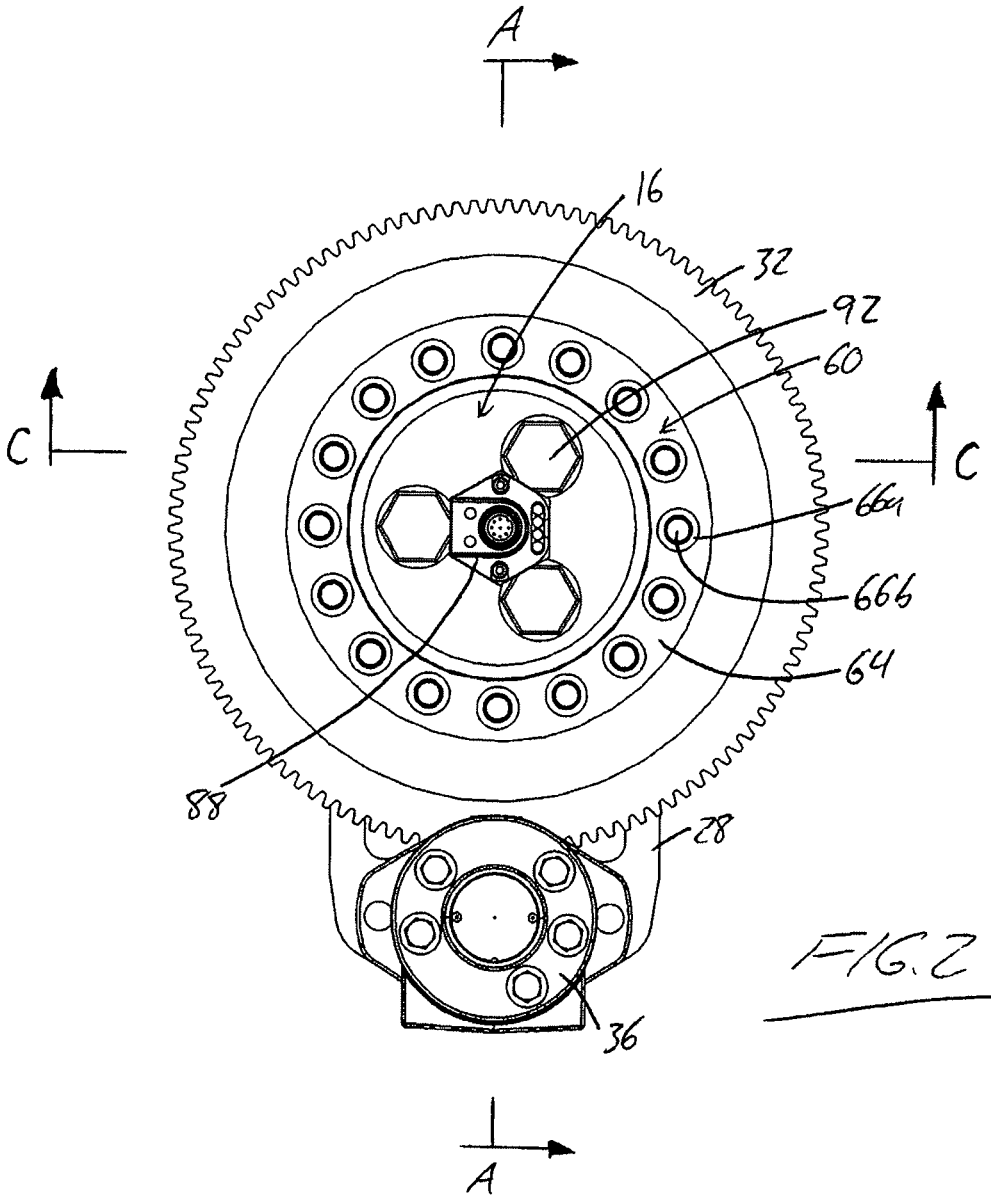
FIG. 2 is an overhead plan view of the artificial lift unit of FIG. 1.
Figure 3:
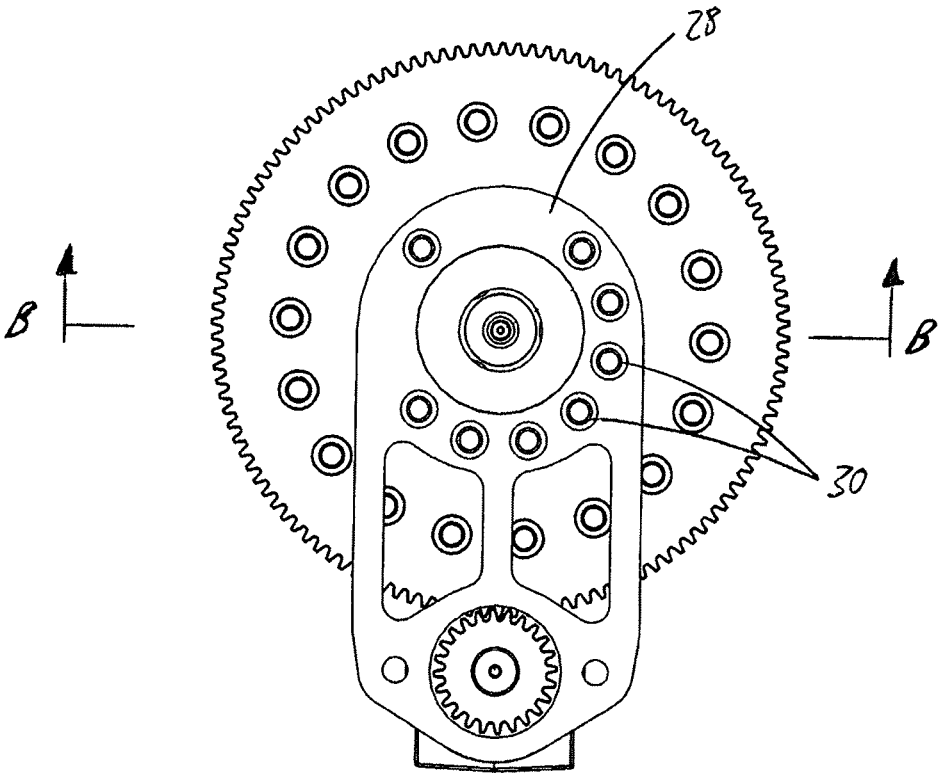
FIG. 3 is a bottom plan view of the artificial lift unit of FIG. 1.

FIGS. 1 to 8 show a first embodiment of an artificial lift system for reciprocally driving a pump rod within the production tubing of a well in order to operate a downhole pump that produces well fluids to the surface through the production tubing. With reference to FIG. 1, The system features a hydraulic linear actuator 10 with a housing having a main hollow cylinder 12 supported in a vertically upright position and closing concentrically around a vertically oriented central longitudinal axis 14. A cap 16 of the housing is fitted atop the hollow main cylinder 12 in a sealed relationship therewith in order to close off a top end of the hollow interior space of the housing in a fluid-tight manner.

Figure 5:
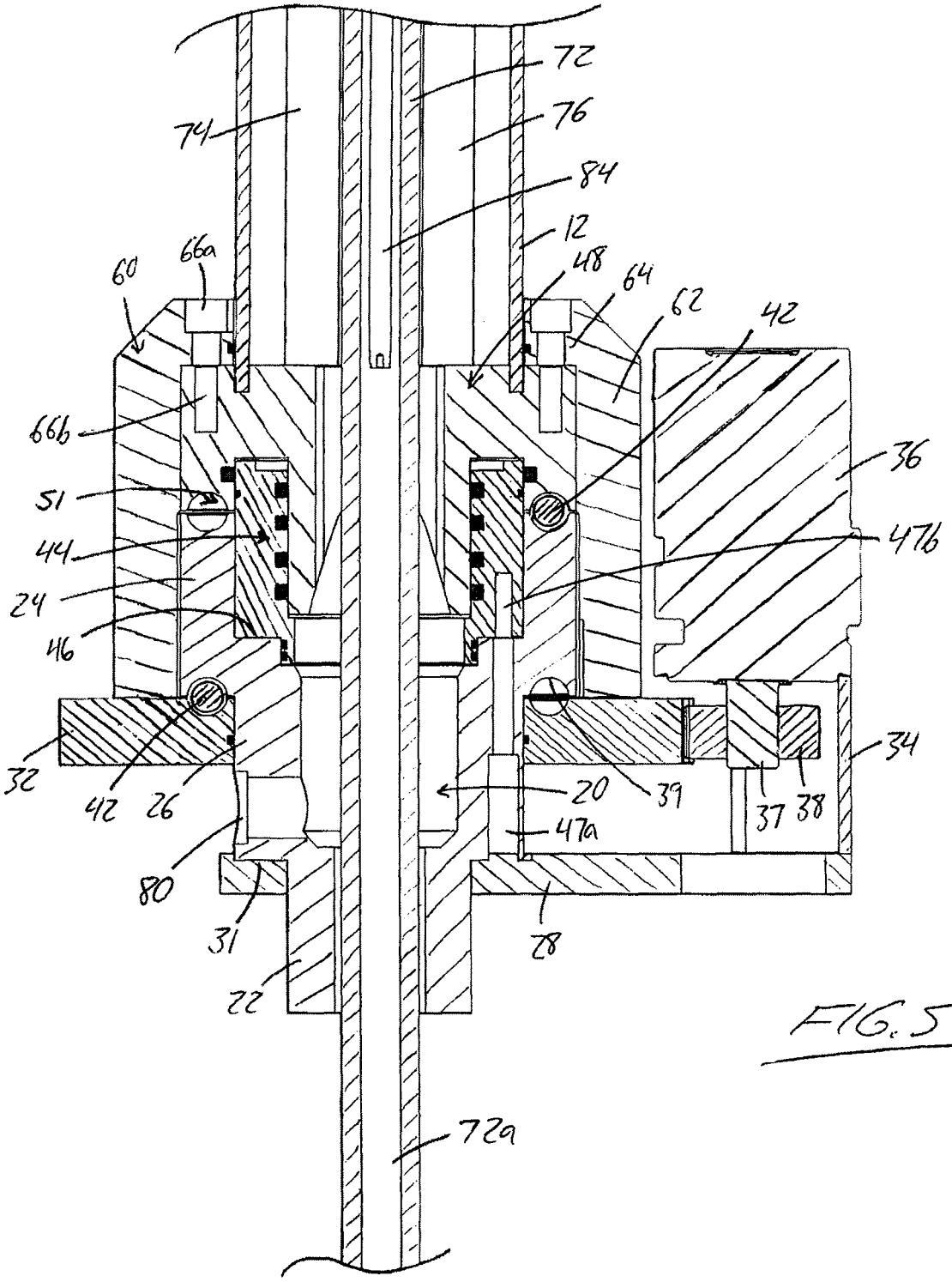
FIG. 5 is a cross-sectional view of a lower portion of the artificial lift unit of FIG. 2 in the vertical plane denoted by line A-A thereof.
Figure 6:
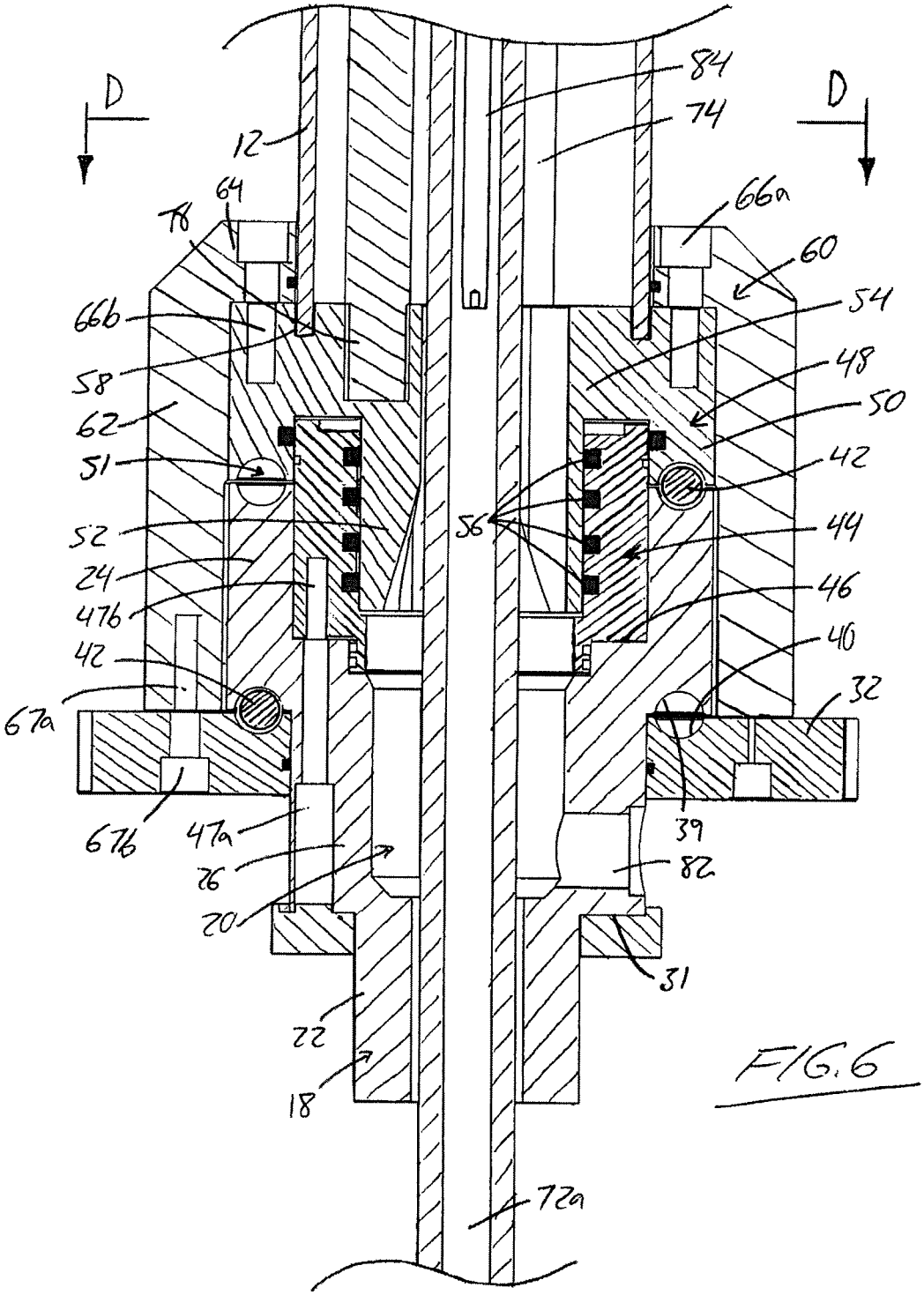
FIG. 6 is a cross-sectional view of the lower portion of the artificial lift unit of FIG. 3 in the vertical plane denoted by line B-B thereof.
Figure 7:
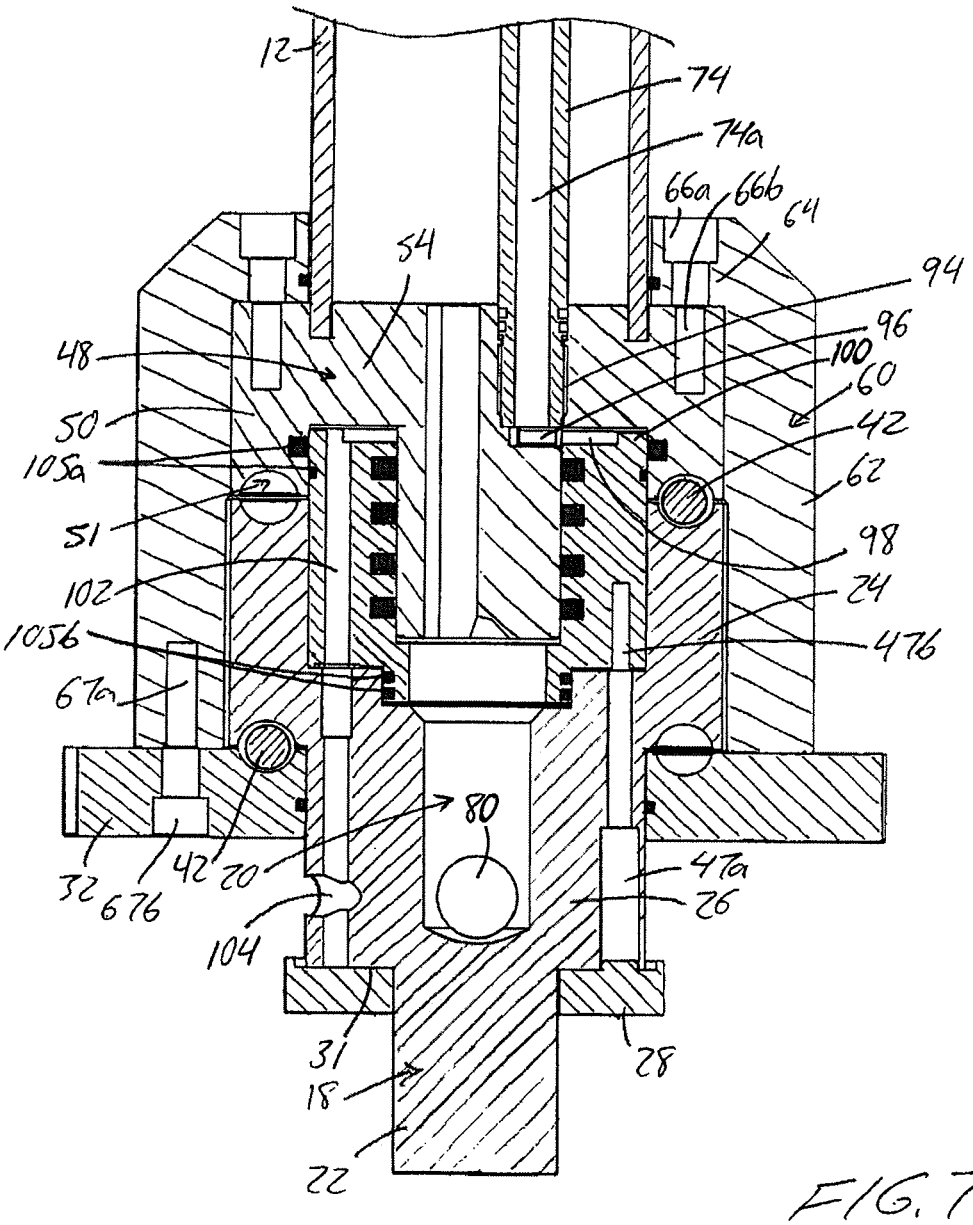
FIG. 7 is a cross-sectional view of the lower portion of the artificial lift unit of FIG. 2 in the vertical plane denoted by line C-C thereof.

A stationary base 18 of the housing resides at a distance beneath the bottom end of the main cylinder 12. With reference to FIGS. 5 to 7, the stationary base 18 has an axial through bore 20 passing through it on the central longitudinal axis 14. An outer diameter of the base 18 is stepped at two locations to divide the base into three distinct sections, namely a lower section 22 of smallest inner and outer diameter, an upper section 24 of largest inner and outer diameter, and a middle section 26 of intermediately sized inner and outer diameters relative to the upper and lower sections.

The lower section 22 of the base 18 passes vertically downward through a mounting opening in a horizontal drive support flange 28 that features an array of bolt holes 30 spaced circumferentially apart from one another around the mounting opening. A first downward-facing shoulder 31 defined by the step in outer diameter between the base's lower section 22 and intermediate section 26 is seated atop the drive support flange 28 around the mounting opening therein, and features a matching array of bolt holes through which the drive support flange and the base are axially bolted together to both fix the base 18 and the drive support flange 28 together axially and prevent rotation therebetween about the central longitudinal axis 14.

The middle section 26 of the base 18 has a ring gear 32 disposed circumferentially therearound at the top end of the middle section just below a second downward-facing shoulder defined between the base's upper section 24 and intermediate section 26 at the change in outer diameter therebetween. The ring gear 32 is centered on and rotatable about the central longitudinal axis 14 relative to the base 18. The drive support flange 28 extends radially away from the central longitudinal axis 14 to one side of the mounting opening therein to carry a motor mount 34 at a distance radially outward from the ring gear 32 in a position standing upward from the drive support flange 28. A hydraulic motor 36 is mounted atop the motor mount 34 with its output shaft 37 reaching downwardly from the motor housing on an interior side of the motor mount 34, where the output shaft 37 of the motor carries a pinion gear 38 in a position mating with the toothed periphery of the ring gear 32 at a location between the ring gear and the motor mount 34. Accordingly, driven rotation of the pinion gear 38 by the hydraulic motor 36 will drive rotation of the ring gear 32 about the central longitudinal axis of the main cylinder 12. As described in more detail below, driven rotation of the ring gear drives rotation of the main cylinder 12 of the housing, and so the pinion and ring gears respectively define input and output gears of a gear train for transmitting rotational power from the motor to the main cylinder 12 of the housing.

While the illustrated embodiments each employ a ring gear drive train in of which the input member is pinion gear and the output member is a ring gear rotatably supported on the base, other drive types may be used to similar effect. In the case of a ring gear drive chain, one or more intermediate gears may be used to indirectly couple the input and output gears of the drive chain. Alternatives include belt-driven or chain-driven drives, in which the input member is a pulley or sprocket on the motor shaft and the output motor is a pulley or sprocket rotatably supported on the base, and rotationally coupled to the input pulley/sprocket by a belt or chain. Toothed or untoothed belts and pulleys may be employed. Regardless of the particular drive train employed, the motor may be hydraulically, pneumatically or electrically powered.

The second downward-facing exterior shoulder of the base 18 defined by the stepped outer diameter between upper and middle sections thereof is arcuately contoured in a concave manner, as shown at 39, and the topside of the ring gear 32 features a corresponding recess of concavely arcuate cross-section 40 encircling the inner periphery of the ring gear 32 around the base's middle section 26. The concave recess 40 of the ring gear 32 aligns with the arcuately contoured shoulder 39 of the base 18 to define a spherical raceway between the ring gear 32 and the upper section 24 of the base 18. Spherical roller elements 42 are received within this raceway to define a first bearing between the ring gear 32 and the base 18.

A seal insert 44 is seated within the upper section 24 of the base 18 atop an interior upward facing shoulder 46 thereof where the through-bore 20 of the base 18 decreases in diameter near the transition between the upper and middle sections 24, 26 thereof. A second array of circumferentially spaced apart bolt holes 47*a* are provided in the first downward-facing exterior shoulder 31 of the base 18, and are circumferentially offset from the first set of bolt holes (not shown) through which the drive support flange 28 is coupled to the base 18. The second array of bolt holes 47*a* in the first exterior shoulder 31 of the base 18 extend upwardly through the upwardly facing interior shoulder 46 of the base's upper section 24, and the seal insert 44 has a matching set of bolt holes 47*b* extending upwardly thereinto at an annular downward-facing surface of the seal insert 44 that overlies the interior shoulder 46 of the base's upper section. Through these aligned bolt holes 47*a*, 47*b* in the base 18 and the seal insert 44, bolts (not shown) are used to fasten the seal insert 44 to the base 18, which in turn is fastened to the drive support flange 28 by another set of bolts (not shown), as described above. These two sets of bolts thereby axially couple the drive support flange 28, base 18 and seal insert 44 together and prevent relative rotation between these three components about the central longitudinal axis 14.

A base cover 48 fits over the base 18 and the seal insert 44 at the annular upper end of the base's upper section 24. The base cover 48 features a cylindrical outer rim 50 that resides over the annular upper end of the base's upper section 24. The outer rim 50 of the base cover 48 circumferentially surrounds an upper portion of the seal insert 44 that reaches upwardly past the upper end of the base 18. The annular upper end of the base 18 and the annular bottom end of the base cover's outer rim 50 are both concavely contoured in vertical planes emanating radially outward from the central longitudinal axis so to cooperatively define another circular raceway 51 like that defined between the topside of the ring gear 32 and the downward facing shoulder at the lower end of the base's upper section 24. Spherical roller elements 42 are once again disposed within this second raceway 51, thereby defining a second bearing enabling relative rotation between the base 18 and the base cover 48. In the vertically cross-sectioned figures, only one such roller element 42 in shown in each spherical raceway to enable clear labelling of the both the raceway and the roller element contained therein, though it will be appreciated that a full set of roller elements is provided in each raceway.

In addition to the outer rim 50, the base cover 48 also features an inner body 52 of externally cylindrical shape, and an upper web 54 radially interconnecting the outer rim 50 and inner body 52 at the upper end of the base cover 48. The inner body 52 is spaced radially inwardly from the outer rim 50 and extends downwardly from the web 54 into an internal through-bore of the seal insert 44 by a distance reaching past the bottom end of the base cover's outer rim 50. A plurality of circumferential grooves are provided in the boundary wall of the seal insert's internal through-bore and contain ring-shaped seals 56 therein to form fluid-tight seals between the seal insert 44 and the inner body 52 of the base cover 48.

The web 54 at the upper end of the base cover 48 features an annular slot 58 recessed thereinto just inside the outer rim 50. The lower end of the hollow main cylinder 12 is received within the annular slot 58. A downward-opening containment collar 60 has a circumferential wall 62 closing around the upper section 24 of the base 18 and the base cover 48 mounted thereatop. An internal flange 64 of the containment collar 60 at the upper end thereof overlies the outer rim 50 of the base cover 48 around the hollow main cylinder 12. An array of bolt holes 66*a* extend downwardly through the internal flange 64 of the containment collar 60 at circumferentially spaced positions therearound and align with a respective circumferential array of bolt holes 66*b* in the annular upper end of the outer rim 50 of the base cover 48, whereby the containment collar 60 and the base cover 48 are axially coupled together and rotationally locked to one another by another set of bolts (not shown). With reference to FIG. 6 or 7, another array of circumferentially spaced bolt holes 67*a* open upwardly into the circumferential wall 62 of the containment collar 60 at the bottom end thereof and align with a matching circumferential array of bolt holes 67*b* passing axially through the ring gear 32, whereby the ring gear 32 is bolted to the containment collar 60. As a result, the containment collar 60 and the base cover 48 rotate together with the ring gear 32 under driven operation of the hydraulic motor 36. With the lower end of the hollow main cylinder 12 fixed in the annular slot 58 of the base cover 48, the hollow main cylinder 12 is thus rotatable about its central longitudinal axis 14 by driven operation of the hydraulic motor.

Figure 4:
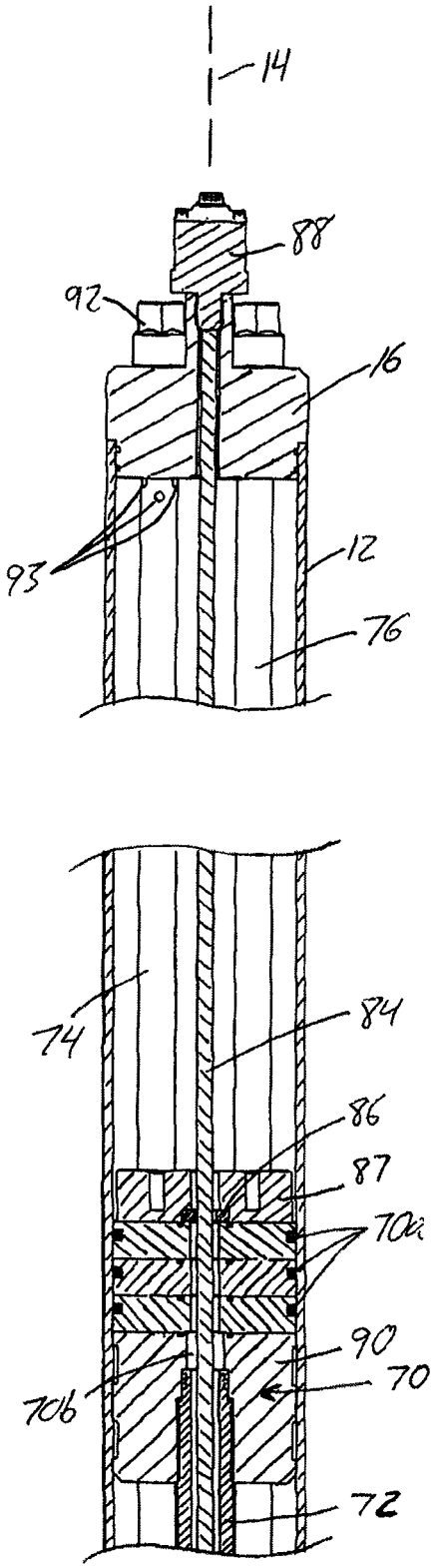
FIG. 4 is a cross-sectional view of an upper portion of the artificial lift unit of FIG. 2 in a vertical plane denoted by line A-A thereof.

With reference to FIG. 4, a piston 70 is slidably sealed to the interior surface of the main cylinder 12 by piston seals 70*a* and is centered on the central longitudinal axis 14 for back and forth longitudinal sliding of the piston within the hollow main cylinder 12. A piston shaft 72 is attached to the piston 70 and extends downwardly therefrom along the central longitudinal axis 14 of the cylinder 12. The piston shaft 72 reaches downwardly through the axial bore 20 of the base 18 via an aligned axial through-hole of the base cover 48. A set of anti-rotation rods 74, 76, 78 extend axially from the cap 16 of the hydraulic linear actuator 10 down to the base cover 48 at respective positions spaced circumferentially around the central longitudinal axis 14 at a distance radially outward from the piston shaft 72. The base cover 48 features a set of threaded blind holes extending axially thereinto at the upper end thereof for threaded receipt the bottom ends of the anti-rotation rods, and the piston 70 contains a set of axial through bores therein via which these anti-rotation rods 74, 76, 78 pass through the piston. The piston thus slides back and forth along the anti-rotation rods during its travel back forth on the central longitudinal axis 14 within the confines of the hollow main cylinder 12. The offset position of each anti-rotation rod from the central longitudinal axis 14 of the hydraulic linear actuator prevents relative rotation between the piston and the main cylinder 12 about the central longitudinal axis. Therefore, rotation of the main cylinder 12 under driven operation of the hydraulic motor 36 causes the piston 70 and the attached piston shaft 72 to rotate with the surrounding main cylinder 12. With the hydraulic linear actuator 10 mounted in an upright position atop a wellhead, the piston shaft 72 passes downwardly through the wellhead into a production tubing string of the well, where the lower end of the piston shaft is connected to a pump rod that continues downward through the production tubing to a downhole pump for producing well fluids to the surface through the production tubing. As is known in the art, the pump rod may be a continuous rod, or a string of discrete rods axially coupled together by matingly threaded ends of the rods.

Figure 11:
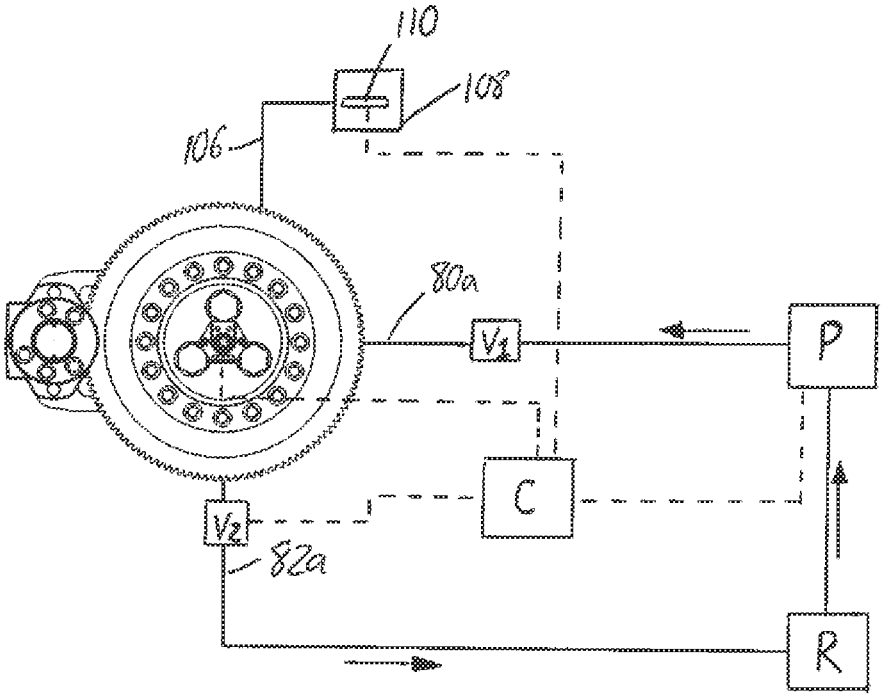
FIG. 11 schematically illustrates a hydraulic control system controlling operation of the artificial lift units of FIG. 1 and FIG. 10, inclusive In the drawings like characters of reference indicate corresponding parts in the different figures.

With reference to FIG. 5, the middle section 26 of the base 18 features an upstroke supply port 80 extending radially through its circumferential wall into the axial through-bore 20 of the base 18 at one side thereof. Referring to FIG. 11, a hydraulic supply line 80*a* is connected to this upstroke supply port 80 to deliver pressurized hydraulic fluid into to the base 18 of the hydraulic linear actuator from a hydraulic pump P that sources the hydraulic fluid from a fluid reservoir R. A check valve $V_1$ is installed in the upstroke supply port 80 or on the supply line 80*a* to prevent backflow of hydraulic fluid into the supply line 80*a* from the axial through-bore 20 of the base of the hydraulic linear actuator 10. Turning to FIG. 6, at another side of the base 18, a separate return port 82 extends radially through the circumferential wall of the middle section of the base 18 into the axial through-bore 20 of the base. Referring again to FIG. 11, a hydraulic return line 82*a* is connected to this return port 82 to convey hydraulic fluid from the base 18 back to the fluid reservoir during a downstroke of the hydraulic linear actuator 12. The exterior diameter of the piston rod 72 is less than the internal diameters of the base's upper and middle sections 24, 26, and also less than the internal diameters of the seal insert 44 and the inner body 52 of the base cover 48. The interior of the lower section 22 of the base 22 carries a seal (not shown) through which the piston shaft 72 extends in a manner slidable therethrough but fluid-tight therewith, thereby providing a sealed closure of the interior space of the hydraulic linear actuator at the based-defined bottom end of its housing.

Figure 8:
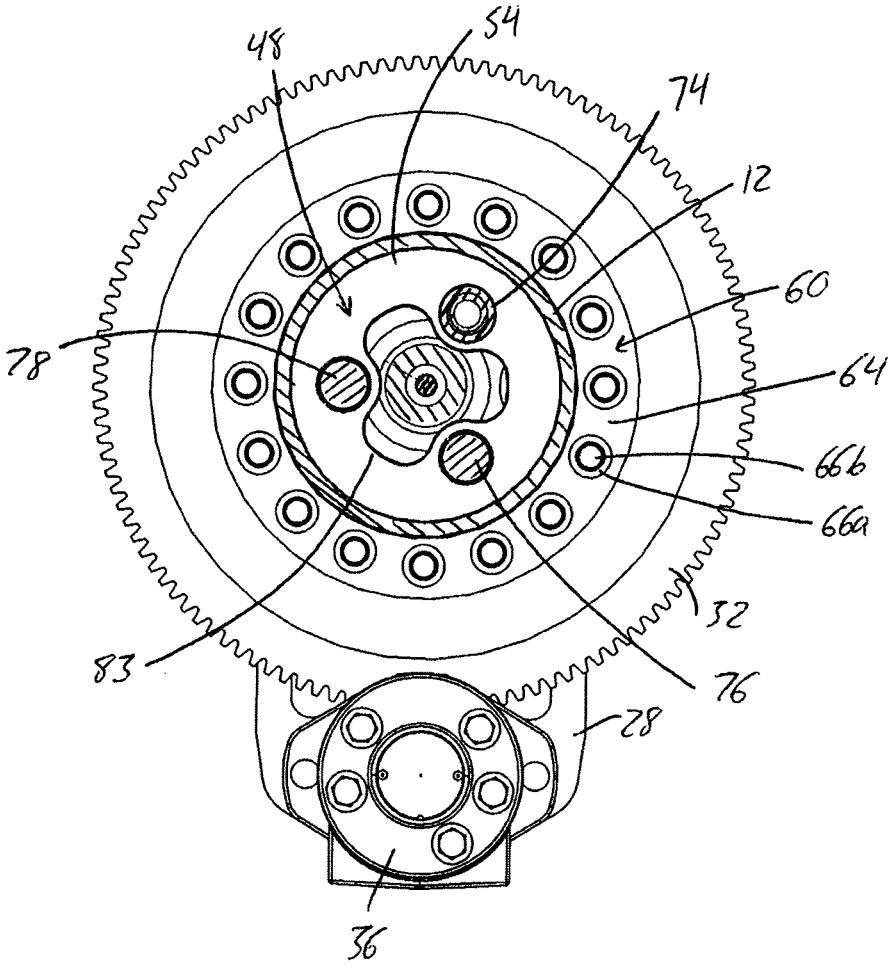
FIG. 8 is a cross-sectional view of the lower portion of the artificial lift unit of FIG. 6 in the horizontal plane denoted by line D-D thereof.

The axial passage through the inner body 52 of base cover 48 at the central longitudinal axis 14 to accommodate passage of the piston rod 72 therethrough has a three-lobed shape spanning radially outwardly from the piston rod at areas between the three anti-rotation rods 74, 76, 78, as shown at 83 in FIG. 8. Accordingly, the piston rod 72 is surrounded by open space throughout its travel through the base cover 48, the seal insert 44 and the upper and middle sections 24, 26 of the base 18, whereby pressurized hydraulic fluid fed into the base 18 through the upstroke supply port 80 can fill this space and rise upwardly into to the main cylinder 12 in order to drive the upstroke of the piston. The lowermost travel position of the piston is limited by eventual impact against the top end of the base cover 48, and so the positioning of the upstroke supply port 80 in the middle section 26 of the base 18 places it in a lower portion of the housing's interior space between the lowermost travel limit of the piston 70 and the sealed closure of the housing at the lower end of the base. Accordingly, introduction of pressurized fluid through the upstroke supply port 80 delivers the hydraulic fluid into the interior space of the housing at a point situated below the lowermost attainable position of the piston seals 70*a* at the bottom end of the downstroke so that this fluid will force the piston upward to initiate the upstroke.

To achieve such pressurization of the hydraulic linear actuator beneath the piston during the upstroke, a control valve $V_2$ installed at the return port 82 or on the return line 82*a* coupled thereto is held closed during the upstroke. The upstroke of the piston is caused by termination of the incoming supply of pressurized fluid to the hydraulic linear actuator, and opening of the return line's control valve $V_2$ so that the hydraulic fluid can drain from the base of the hydraulic linear actuator back to the reservoir R through the return line 82*a*. In the illustrated embodiment, the upstroke supply port 80 is the only hydraulic fluid supply port, but there is also a leak detection passage described in later detail below that opens up to the interior space of the housing near the capped top end of the housing at which the cap 16 defines the uppermost travel limit of the piston. Therefore, the hydraulic linear actuator 12 is a two way linear actuator that lacks hydraulic pressure return on the downstroke. As a result, the downstroke of the piston 70 is effected gravitationally by the weight of the piston 70, piston shaft 72 and attached pump rod. The combined weight of these components pulls the piston 70 downwardly, which forces the hydraulic fluid out of the hydraulic linear actuator through the return port. On downstroke the chamber above the piston is atmospherically controlled though the leak detection passage that is described in further detail below and is collectively formed by elements 74*a*, 96, 98, 102, 104 in FIG. 7. Attached to the piston, for example by a threaded connection thereto, the piston shaft 72 is driven upwardly and downwardly by the upstroke and downstroke of the piston to drive the downhole pump via the pump rod. With the main cylinder 12 being rotatable relative to the wellhead by the hydraulic motor 36, and with the piston and piston shaft being rotationally locked to the cylinder 12 by the anti-rotation rods, the driven rotation of the cylinder 12 likewise drives rotation of the piston 70 and thus the pump rod coupled thereto by the piston shaft 72. Accordingly, the cylinder 12 can be rotated in either direction about its longitudinal by operation of the reversible hydraulic motor in a respective direction in order to drive any downhole tools or equipment requiring rotational input.

With reference to FIG. 4, to control the timing of the start and end of the hydraulically powered upstroke, the hydraulic linear actuator incorporates a positional detection device operable to detect positional information concerning travel of the piston 70 back and forth within the housing of the hydraulic linear actuator. The positional detection device of the first illustrated embodiment is a magnetostrictive linear-position sensor with a sensing rod 84 passing axially through and downwardly from the cap 16 of the hydraulic linear actuator to the base cover 48 on the central longitudinal axis 14, thus spanning an entirety of the piston's available travel range between the underside of the cap 16 and the upper end of the base cover 48. The piston shaft 72 is hollow over at least a substantial majority of its length, and therefore has a hollow interior bore 72*a* extending axially thereinto from its top end that is coupled to the piston 70. The piston features an axial through bore 70*b* having a threaded lower portion into which the top end of the piston shaft is threaded at the bottom end of the piston. The piston's axial bore 70*b* continues upwardly from the top end of the hollow piston shaft 72 to the topside of the piston. The sensing rod 84 extends downwardly through the axial bore 72*b* of the piston 70 into the hollow interior bore 72*a* of the piston shaft 72. The combined axial bore through the piston and piston shaft from the topside of the piston to the bottom end of the piston shaft exceeds the length by which the sensing rod 84 extends downward from the cap 16 so that the sensing rod never fully reaches the bottom end of the piston shaft, even at the uppermost limit of the piston's travel. The piston features a ring-shaped magnet 86 in a position spanning circumferentially around the central opening thereof, for example sandwiched between a bolt-on cap 87 of the piston that is axially bolted to the top end of a main seal-carrying body 90 of the piston, to which the piston shaft is attached.

Accordingly, the magnet 86 spans circumferentially around the sensing rod 84, whereby a signal processing head 88 of the magnetostrictive position sensor positioned outside the hydraulic linear actuator above the cap thereof can detect the current position of the piston 70 along the sensing rod 84 at any given moment based on the detected position of the magnet 86 therealong. The head 88 of the sensor is connected to an electronic controller C responsible for initiating and terminating supply of pressurized hydraulic fluid to the hydraulic linear actuator from the hydraulic pump. When the sensor detects arrival of the piston at a preselected lower-limit of the piston's desired travel range under gravitational fall of the piston during the downstroke, the controller closes the control valve $V_2$ and activates the pump P to initiate the supply of hydraulic fluid to hydraulic linear actuator 10 through the base 18 thereof, thereby pressurizing the lower portion of the housing's interior space below the piston, and thus initiating the upstroke. When the sensor detects arrival of the piston at a preselected upper-limit of the piston's travel range during the upstroke, the controller C deactivates the pump to terminate the supply of the hydraulic fluid and opens up the return port control valve $V_2$, thereby depressurizing this lower portion of the housing to enable initiation of the gravitationally driven downstroke. The controller may be programmable to enable user-specification or adjustment of the selected lower and upper limits of the piston travel range, which may be selected to precede the hard maximum limits set by the cap and the base cover so that physical impact of the piston with the cap and base cover is prevented during normal operation. While the detailed embodiment uses a magnetostrictive position sensor, other linear displacement sensor devices could be used. For example, a hall effect sensor mounted to a bottom end of a plain rod or shaft could be used to form a detection rod to cooperate with magnetically coded areas on the piston shaft to provide contactless monitoring of the shaft position. As another option, contact switches on either the piston shaft interior or detection rod exterior could cooperate with raised areas on the other for contact-based linear position detection. However, the need for only a singular magnet for operation of a magnetostrictive sensor allows for simple placement of the magnet externally of the piston rod at or near the upper end thereof, for example within the piston itself, avoiding the need for more complicated placement of magnetic elements or switches within the hollow piston shaft.

As shown in FIG. 7, one of the anti-rotation rods 74 is hollow so as to define an axial passage 74*a* extending fully therethrough between its top and bottom ends. As shown in FIG. 4, a threaded nut or cap 92 is fitted on the top end of the hollow anti-rotation rod 74 outside the hydraulic linear actuator in order to close off the top end of the hollow rod's axial passage 74*a*. Likewise, each other anti-rotation rod, whether hollow or not, is fitted with a threaded nut or cap 92 at the top end of the anti-rotation rod to clamp downward on the top end of the main cylinder 12, which holds the bottom end of the cylinder down in the annular slot 58 of the base cover 48. Just below the cap 16, at least one radial hole 93 passes through the circumferential wall of the hollow anti-rotation rod 74 so as to fluidly communicate the axial passage 74*a* thereof with the interior space of the housing at a location above the upper travel limit of the piston seals 70*a* during the upstroke of the piston. Turning back to FIG. 7, the respective through hole 94 in the base cover 48 that receives the open lower end of the hollow anti-rotation rod 74 is open to the outer periphery of the of the inner body 52 of the base cover 48 at the bottom end of this blind hole 94 by way of a radial port 96 machined into the exterior of the base cover's inner body 50 to intersect with the bottom end of the through hole 94. This radial port 96 opens into an annular space 98 that exists in an axial gap between the web 54 of the base cover 48 and an annular outer rim 100 of the seal insert 44, which stands upward from the remainder of the seal insert 44 at the top end thereof. An axial drain channel 102 runs downwardly through the seal insert 44 from this annular space 98 to the interface between the annular downward-facing surface of the seal insert 44 and underlying interior shoulder 46 of the base 18, from which the drain channel 102 continues into the middle section 26 of the base 18, where the drain channel 102 intersects with a leak detection port 104 that extends radially outward to the exterior of the base's middle section 26 at a position below the ring gear 32. The leak detection port 104 does not fully penetrate the circumferential wall of the base's middle section 26, and instead terminates short of the interior bore 20 of the base 18 so that the leak detection port 104 is fluidly isolated therefrom.

Accordingly, the axial passage 74*a* of the hollow anti-rotation rod 74, the respective blind hole 94 of the base cover 48, the radial port 96 of the base cover, the annular space 98 between the base cover and the seal insert 44, and the axial drain channel 102 of the base 18 and seal insert 44 all cooperate to form a leak detection passage from the uppermost area of the cylinder's interior space down to the leak detection port 104. Seals 105*a* between the interior of the base cover's outer rim 50 and the exterior of the seal insert 44 and seals 105*b* between the exterior of a reduced-diameter lower end of the seal insert 44 and a reduced-diameter portion of the interior of the base's upper section 24 below the upward facing shoulder 46 thereof cooperate with the interior seals of the seal insert 44 to fluidly isolate the leak detection passage from the interior space of the housing below the piston 70. In the event of a piston seal failure by which the hydraulic fluid introduced into the lower portion of the housing through the upstroke supply port can leak across the piston into the upper portion of the housing above the piston, the upstroke of the piston will force this leaked fluid upwardly toward the cap 16 of the housing and into the axial passage 74*a* of the hollow anti-rotation rod 74*a* via the radial holes 93 therein. The leaked fluid will thus drain down through the leak detection passage to the leak detection port 104, where the presence of fluid will thus indicate the existence of a leak across the piston. A leak detection line 106 is coupled to the leak detection port 104 and leads to a leak containment tank 108 which receives the leaked fluid and isolates same from the surrounding environment. A leak detection sensor is cooperable with the leak detection passage, port, line and tank in order to trigger an alarm or notification, and/or cause shut-down of the hydraulic linear actuator, upon detecting presence or accumulation of leaked hydraulic fluid within this leak detection system. For example, the sensor may be a float sensor 110 mounted in the leak containment tank for actuation upon accumulation of a predetermined level of fluid within the containment tank. The sensor may be connected to the controller C or to a shut-down switch of the hydraulic pump P so that triggering of the sensor terminates operation of the pump to shut down operation of the linear actuator until an inspection and reset of the system can be performed.

The first illustrated embodiment provides a hydraulically powered artificial lift system for reciprocally driven downhole pumps that can additionally be used to operate rotationally driven downhole equipment, that places its position-detection rod internally within the housing while using a hollow piston shaft to isolate the position-detection rod from the pressurized hydraulic fluid introduced in the lower portion of the housing, that incorporates a leak detection and containment solution to prevent environmental contamination, and that provides all fluid line connections at the bottom of the housing for convenient access and leak containment.

Figure 9:
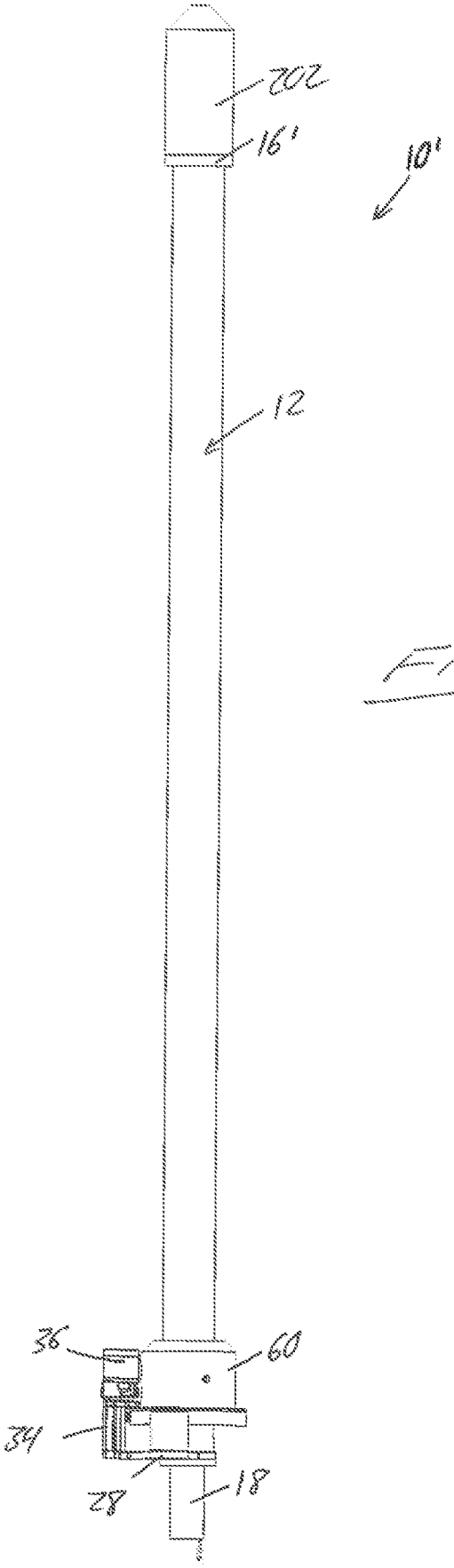
FIG. 9 is a rear elevational view of an artificial lift unit according to a second embodiment of the present invention.
Figure 10:
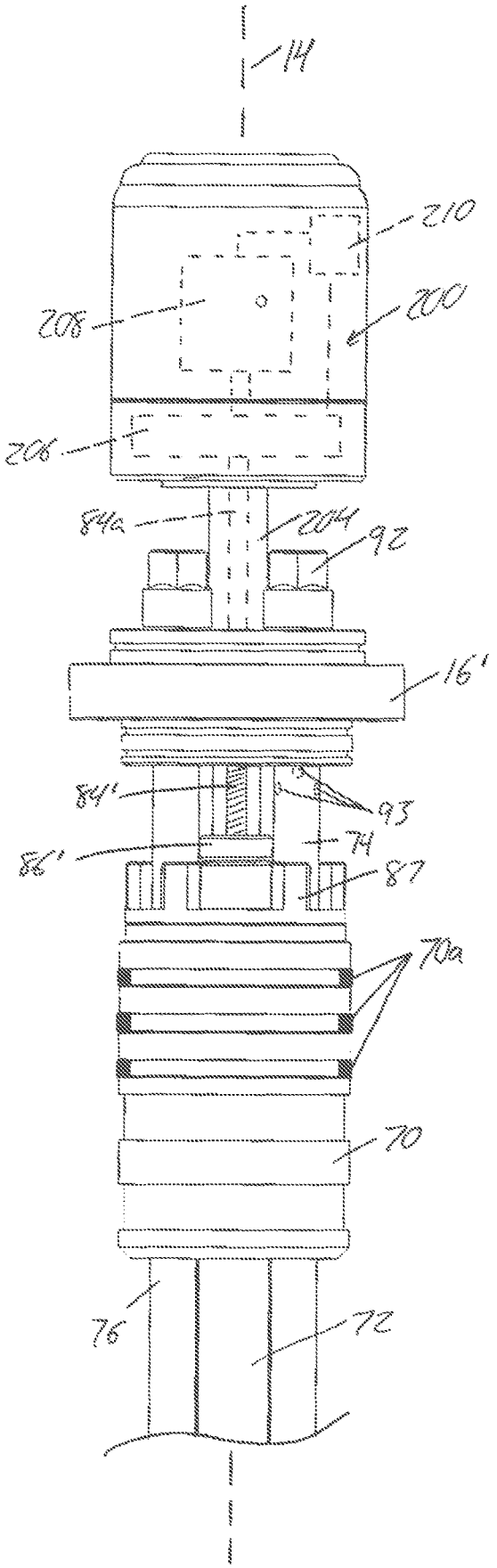
FIG. 10 is a partial rear elevational view of the artificial lift unit of FIG. 9, with a main cylinder housing and a cap cover thereof omitted to reveal internal components of the unit.

FIGS. 9 and 10 show a second embodiment artificial lift unit 10' that differs from first in its type of positional detection device, and in the addition of a multi-function processing module 200 mounted inside a cap cover 202 at the top end of the main cylinder 12. FIG. 9 shows the fully assembled lift unit 10', in which cap cover 202 is engaged over the cap 16' of the main cylinder 12. In this embodiment, the cap 16' features a central stand-off 204 that reaches vertically upward from the cap 16' on the central longitudinal axis of the housing 12 in order to carry the processing module 200 in an elevated position over the nuts/caps 92 of the anti-rotation rods 74, 76, 78. The stand-off 204 is hollow, and its bottom end communications with a central through-bore of the main cylinder cap 16'. The sensing rod of the first embodiment is replaced with a screw rod 84' (e.g. a ball screw rod) that extends downwardly from the cap 16' on the central longitudinal axis of the main cylinder 12, through the central bore of the piston 70 and into the piston shaft 74, just like the sensing rod of the first embodiment. Instead of a magnet, the piston 70 in the second embodiment carries a nut 86' that is fixed on bolted cap 87 of the piston 70 and is mated with the screw rod 84'. As a result, linear displacement of the piston 70 in the longitudinal direction of the main cylinder 12 by hydraulic or gravitational action causes the screw shaft 84' to rotate due to its mated engagement with the piston-carried nut 86'.

A smooth walled upper extension 84*a* of the screw rod 84' reaches upwardly through the cap 16' of the main cylinder through a fluid-tight rotation-allowing seal. The rod extension 84*a* continues upwardly through the hollow interior of the standoff 204 and into the bottom end of the module 200. Inside the module's outer enclosure, the rod extension 84*a* passes axially through a rotary encoder 206 and then further upward to an electrical generator 208. The rotary encoder 206 is operable to monitor the rotation of the rod extension 84*a* and attached screw rod 84*a* about the central longitudinal axis 14 of the main cylinder 12. The same rotation of the rod extension 84*a* is operable to drive the generator and thereby provide power for electrical components of the lift unit 10', which in the illustrated examples include both the rotary encoder 206 and a wireless transmitter 210. The transmitter 210 is communicably coupled to the rotary encoder to receive electronic signals therefrom that represent current position of the piston along the screw rod based on the detected direction and angulation of the screw-rod's rotation.

Hydraulic lifting of the piston 70 rotates the screw rod 84' in one direction, while gravitational fall of the piston 70 rotates the screw rod 84' in the other direction. Accordingly, monitoring of the direction and number of rotations of the screw rod by the rotary encoder 206 serves to monitor the movement and position of the piston 70 along the longitudinal axis of the cylinder 12 relative to an initial starting position of the piston. The electrical power gained from the generator during any such rotation of the screw rod is stored in one or more capacitors, batteries or other electrical stores, and is used to power the rotary encoder 206 and the wireless transmitter 210. The module 200 thus replaces the signal processing head 88 in the first embodiment and wirelessly communicates the data signals from the rotary encoder concerning the positional information on the piston to the separate electronic controller responsible for controlling the supply and relief of the hydraulic fluid to and from the main cylinder 10.

Operation of the second embodiment artificial lift unit 10' is similar to that described above for the first embodiment in relation to FIG. 11, except that a wired connection from the top of the artificial lift unit down to a ground level controller C is not required due to the inclusion of the wireless transmitter in the module 200. In the first embodiment, if a wired connection is used instead of a wireless transmitter, then a slip ring is employed at the top end of the main cylinder to provide electrical connection between the wired connection and the sensor head 88 at the top of the rotatable cylinder to accommodate the rotational motion thereof.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A hydraulic artificial lift apparatus for operating a downhole pump of a well to produce fluids therefrom, the artificial lift apparatus comprising:

a housing having a top end and an opposing bottom end spaced apart in a longitudinal direction of the housing, the housing comprising a base residing at said bottom end of the housing and a cylinder that stands upwardly from said base and is capped capped at the top end of the housing;

a piston slidably disposed within a hollow interior space of the housing for movement back and forth in the longitudinal direction between an uppermost travel limit situated proximate to the top end of the housing and an opposing lowermost travel limit situated proximate to and above the base, said piston being centered on a central longitudinal axis of the cylinder and sealed to a circumferential wall of the cylinder by at least one piston seal;

a piston shaft attached to the piston and extending downward therefrom and exiting the housing through the base thereof, which features a sealed closure of the base around said piston shaft, a lower end of the piston shaft being disposed outside the housing below the base thereof and connected or connectable to the upper end of a pump rod for reciprocal driving of the downhole pump by said movement of the piston;

an upstroke supply port penetrating an exterior of the base and fluidly communicating with the hollow interior space of the housing at a location situated between the sealed closure and a lowermost position occupied by the at least one piston seal at the lowermost travel limit of the piston, the upstroke supply port being configured for connection of an external hydraulic supply thereto at said exterior of the base to receive pressurized hydraulic fluid from an external source, whereby the hydraulic fluid is first introduced to the housing at the base thereof and is admitted to the hollow interior space below the lowermost position of at the at least one piston seal to drive an upstroke of the piston; and at least one anti-rotation rod running longitudinally of the hollow interior space of the housing inside the cylinder thereof and through the piston at a position radially offset outwardly from the central longitudinal axis, the piston being longitudinally slidable on said at least anti-rotation rod between the uppermost and lowermost travel limits;

wherein:

the housing comprises a rotatable portion that includes said cylinder and is supported for rotation about the central longitudinal axis thereof, and the at least one anti-rotation rod prevents relative rotation of the piston and the piston shaft relative to said rotatable portion of the housing; and the base at which the upstroke supply port is defined is stationary, and said rotatable portion of the housing is rotatably supported atop said base for relative rotation thereto.

2. The apparatus of claim 1 comprising a rotational actuation device operable to effect controlled rotation of said rotatable portion of the housing.

3. The apparatus of claim 2 wherein the rotational actuation device comprises a motor mounted in a stationary position relative to the well and a drive train comprising an input driven by the motor and an output connected to said rotatable portion of the housing.

4. The apparatus of claim 3 comprising a drive support flange on which the base of the housing is fixed, and on which said motor is mounted in the stationary position radially offset from the housing to one side thereof.

5. The apparatus of claim 1 comprising a solid rod running longitudinally of the hollow interior space of the housing inside the cylinder thereof from a supported position above the upper travel limit of the piston, wherein the piston shaft comprises a hollow interior bore extending axially thereinto from a top end of the piston shaft and communicating with the hollow interior space of the housing above the piston, wherein the solid rod extends into the hollow interior bore of the piston shaft.

6. The apparatus of claim 5 wherein the solid rod comprises a screw rod and the piston carries a nut which is engaged on said screw rod such that movement of the piston along the screw rod in the longitudinal direction drives rotation of said screw rod.

7. The apparatus of claim 6 comprising a rotary encoder operable to monitor rotation of said screw rod and derive the positional information therefrom.

8. The apparatus of claim 6 further comprising a generator operably coupled to the screw rod to generate electrical power from rotation of said screw rod.

9. A hydraulic artificial lift apparatus for operating a downhole pump of a well to produce fluids therefrom, the artificial lift apparatus comprising:

a housing having a top end and an opposing bottom end spaced apart in a longitudinal direction of the housing, the housing comprising a base residing at said bottom end of the housing and a cylinder that stands upwardly from said base and is capped at said top end of the housing;

a piston slidably disposed within a hollow interior space of the housing for movement back and forth in the longitudinal direction inside the cylinder between the top end of the housing and the base at the opposing bottom end of the housing;

a piston shaft attached to the piston and extending downward therefrom and exiting the hollow interior space of the housing through the base thereof, which features a sealed closure of the base around said piston shaft, a lower end of the piston shaft being disposed outside the housing below the base thereof and connected or connectable to the upper end of a pump rod string for reciprocal driving of the downhole pump by said movement of the piston;

a upstroke supply port penetrating an exterior of the base and fluidly communicating with the hollow interior space of the housing, the upstroke supply port being configured for connection of an external hydraulic supply thereto at said exterior of the base to receive pressurized hydraulic fluid from an external source, whereby said hydraulic fluid is first introduced to the housing at the base thereof to drive an upstroke of the piston under introduction of the pressurized hydraulic fluid through said upstroke supply port;

a hollow interior bore extending axially into a top end the piston shaft and communicating with the hollow interior space of the housing above the piston, and a solid rod running longitudinally of the hollow interior space of the housing inside the cylinder thereof from a supported position above an upper travel limit of the piston, and extending downwardly through the piston into the hollow interior bore of the piston shaft;

wherein the piston is movable back and forth along said solid rod in the longitudinal direction, the solid rod is part of a positional detection device operable to detect positional information concerning travel of the piston back and forth in the longitudinal direction, the positional detection device comprises a magnet movably carried with the piston and the piston shaft for sliding movement along the rod, and said solid rod is a sensing rod of a magnetostrictive position sensor.

10. A hydraulic artificial lift apparatus for operating a downhole pump of a well to produce fluids therefrom, the artificial lift apparatus comprising:

a housing having a top end and an opposing bottom end spaced apart in a longitudinal direction of the housing;

a piston slidably disposed within a hollow interior space of the housing for movement back and forth the longitudinal direction between an uppermost travel limit and an opposing lowermost travel limit, said piston being sealed to a circumferential wall of the housing by at least one piston seal;

a piston shaft attached to the piston and extending downward therefrom and exiting the hollow interior space of the housing through the bottom end thereof, which features a sealed closure of the housing around said piston shaft, a lower end of the piston shaft being disposed outside the housing below the bottom end thereof and connected or connectable to the upper end of a pump rod for reciprocal driving of the downhole pump by said movement of the piston;

an upstroke supply port connected or connectable to a source of pressurized hydraulic fluid and entering the housing, and communicating with the interior space thereof, at a lower portion of the housing disposed between the sealed closure and a lowermost position occupied by the at least one piston seal at the lowermost travel limit of the piston, whereby the hydraulic fluid drives an upstroke of the piston, the housing lacking a downstroke port at an upper portion of the housing above an uppermost position occupied by the at least one piston seal at the uppermost travel limit of the piston; and a leak detection fluid passage passing through the piston, communicating with the hollow interior space of the housing at the upper portion thereof, and communicating with a leak detection port at the lower portion of the housing, whereby, in the event of leakage of the pressurized hydraulic fluid upwardly past the piston, leaked fluid above the piston is forced into the leak detection fluid passage as the piston reaches the upper travel limit during the upstroke, and detection of hydraulic fluid in or from the leak detection port confirms occurrence of said leakage.

11. The apparatus according to claim 10 further comprising an external leak detection line coupled to the leak detection port and emptying into a leak containment tank.

12. The apparatus according to claim 10 comprising a sensor installed externally of the housing in cooperation with the fluid detection port to detect presence or accumulation of the leaked fluid, said sensor being connected to a shut-down device operable to terminate conveyance of the pressurized hydraulic fluid to the upstroke supply port.

13. The apparatus of claim 12 wherein the shut-down device comprises a shut-off switch connected to a hydraulic pump from which the pressurized hydraulic fluid is supplied.

14. The apparatus according to claim 10 further comprising a hollow anti-rotation rod running longitudinally of the hollow interior space of the housing inside the cylinder thereof and through the piston at a position radially offset outwardly from a central longitudinal axis on which the piston is centered, the piston being longitudinally slidable on said at least anti-rotation rod between the uppermost and lowermost travel limits, wherein the leak detection conduit comprises an axial passage running through said hollow anti-rotation rod.

15. A hydraulic artificial lift apparatus for operating a downhole pump of a well to produce fluids therefrom, the artificial lift apparatus comprising:

a housing having a top end and an opposing bottom end spaced apart in a longitudinal direction of the housing, the housing comprising a base residing at said bottom end of the housing and a cylinder that stands upwardly from said base and is capped at said top end of the housing;

a piston slidably disposed within a hollow interior space of the housing for movement back and forth in the longitudinal direction between an uppermost travel limit situated proximate to and below the top end of the housing and an opposing lowermost travel limit situated proximate to and above the base, said piston being centered on a central longitudinal axis of the cylinder and sealed to a circumferential wall of the cylinder by at least one piston seal;

a piston shaft attached to the piston and extending downward therefrom and exiting the housing through the base thereof, which features a sealed closure of the base around said piston shaft, a lower end of the piston shaft being disposed outside the housing below the base thereof and connected or connectable to the upper end of a pump rod for reciprocal driving of the downhole pump by said movement of the piston;

an upstroke supply port penetrating an exterior of the base and fluidly communicating with the hollow interior space of the housing at a location situated between the sealed closure and a lowermost position occupied by the at least one piston seal at the lowermost travel limit of the piston, the upstroke supply port being configured for connection of an external hydraulic supply thereto at said exterior of the base to receive pressurized hydraulic fluid from an external source, whereby the hydraulic fluid is first introduced to the housing at the base thereof and is admitted to the hollow interior space below the lowermost position of at the at least one piston seal to drive an upstroke of the piston;

at least one anti-rotation rod running longitudinally of the hollow interior space of the housing inside the cylinder thereof and through the piston at a position radially offset outwardly from the central longitudinal axis, the piston being longitudinally slidable on said at least anti-rotation rod between the uppermost and lowermost travel limits; and a check valve cooperatively installed with the upstroke supply port to prevent backflow of hydraulic fluid through said upstroke supply port, and a separate return port through which hydraulic fluid is dischargeable from the interior space of the housing to an external tank during the downstroke of the piston.

* * * * *